United States Patent [19]

Campbell

[11] 4,342,824

[45] Aug. 3, 1982

[54] DEVELOPER WITH COATED CARRIER MATERIAL AND METHOD OF MAKING

[75] Inventor: Douglas R. Campbell, Derry, Pa.

[73] Assignee: Imaging Systems Corporation, Derry, Pa.

[21] Appl. No.: 153,722

[22] Filed: May 27, 1980

[51] Int. Cl.[3] ..... B05D 1/06

[52] U.S. Cl. ..... 430/108

[58] Field of Search ..... 430/108

[56] References Cited

U.S. PATENT DOCUMENTS

| | | | |
|---|---|---|---|
| 3,632,512 | 1/1972 | Miller | 252/62.1 |
| 3,778,262 | 12/1973 | Queener . | |
| 3,811,880 | 5/1974 | Browning | 430/108 |
| 3,922,382 | 11/1975 | Kukla | 427/58 |
| 4,007,293 | 2/1977 | Mincer | 430/108 |
| 4,042,517 | 8/1977 | Moriconi | 430/108 |
| 4,078,930 | 3/1978 | Mammino | 430/108 |
| 4,209,550 | 6/1980 | Hagenbach | 430/108 |

OTHER PUBLICATIONS

Chemical Products for Coatings & Binders Surfacings & Sealants, Mobay Chemical.

Chemistry for Coatings, Mobay Chemical, Plastic & Coatings Division.

*Primary Examiner*—Sam Silverberg

[57] ABSTRACT

Disclosed herein is a developer with a flowable coated carrier for use in electrophotographic recordings. The carrier is coated with a solution formed by reacting a polyfunctional polyisocyanate with hydroxy containing polymers in the presence of a catalyst. The reaction occurs with a range of 1.4 to 1.55 parts polyfunctional polyisocyanate to one part of the hydroxy containing polymer. A fluid bed process is used to coat the carrier by cycling the carrier material thru a spray of the solution until a desired coating thickness is achieved and then the material is heat cured. The carrier is coated with an alipathic aeromatic cross-linked resin having a longer useful life and better triboelectric stability.

22 Claims, 7 Drawing Figures

DEVELOPER WITH COATED CARRIER MATERIAL AND METHOD OF MAKING

BACKGROUND OF THE INVENTION

This invention has to do with dual component developers for use in electrophotographic recordings and is especially concerned with coated carriers used with such developers.

Developer materials comprise a mixture of toner and carrier particles with the size of the toner particles being relatively small when compared to the size of the carrier particles. Each of the toner and developer have opposite triboelectric charges so that the toner particles are held to the surface of the carrier particles until the developer is moved into contact with a latent electrostatic image at which point the toner particle separate from the carrier particles and attach themselves to the latent image.

The developer material is then re-cycled so as to pick up more toner particles in order to repeat the electrophotographic process. Constant cycling of the carrier particles can cause the particles to lose their configuration, as well as most coating materials used, reduce their cross-sectional dimensions and result in impaction of the toner materials which changes the value of the carrier's triboelectric charge.

The loss or change in the carrier's triboelectric charge has dramatic effects on the quality of the copy produced by the electrophotographic process.

Dual component developers with coated carriers have proven useful and a good description of the problems associated with the carrier components may be had by referral to U.S. Pat. No. 3,778,262 issued to International Business Machines Corporation and disclosing Teflon-S coated carrier components.

The advantages of coated carriers are known, the most important of which to prolong the useful life of the carrier by improving the wear resistance of the carriers and by maintaining the proper triboelectric change on the carrier. Coatings on carriers further prevent oxidation of carriers comprised of ferromagnetic substrate materials. Coating materials have been used with varying results. Lacquer coated carriers, resin coated steel beads along with other resin coatings containing styrene-acrylic co-polymers, vinyl chloride-acetate copolymers, cellulose acetate buyrate and nitrocellulose composition containing charge orienting dyes are known in the industry.

A well known method for applying the coating of the present invention is the WURSTER described in U.S. Pat. Nos. 2,648,609, 2,799,241; and 3,196,827 and 3,241,520 to WURSTER et al. An example of the WURSTER process used to coat flowable carriers is exemplified by U.S. Pat. No. 3,798,167.

It is an object of the present invention to provide a developer with a carrier having a high wear resistance.

It is a further object of the present invention to provide a developer with a carrier having a stable triboelectric performance over its lifetime.

It is a further object of the present invention to provide a dual component carrier with low toner impaction.

It is a further object of the present invention to provide a carrier coating that will enable the use of substrates heretofore not desired in developers.

It is a further object of the present invention to provide carriers having a longer lifetime of use in dual component toners.

BRIEF SUMMARY OF THE INVENTION

According to the present invention a method and application of coating a flowable carrier for dual component toners used in electrophotographic recordings is described. The method comprises the steps of reacting a polyfunctional polyisocyanate with hydroxy containing polymer in the presence of a catalyst for forming a film forming coating solution.

The coating solution is then introduced to the carrier particles preferably by a fluidized bed process so that the outside area of the carrier particles are wetted with the coating solution. Using the WURSTER fluidized bed process the carrier particles are cycled through dual chambers. The first chamber contains the coating solution which is sprayed into the chamber in the form of a mist. The second chamber contains warm dry air in which the solvent vehicle of the solution is evaporated. The carrier particles are preferably heated to 190° F. to 210° F. and preferably cycled through the dual chambers until a desired coating thickness is built up on the carrier particles. The particles are then cured and are ready for use.

When the polyfunctional polyisocyanate is reacted with the hydroxy containing polymers good results have been obtained when from 1.1 to 1.5 parts of the polyisocyanate are reacted with one part of the hydroxy. The most preferably reaction is when from 1.4 to 1.55 parts of the polyisocyanate is reacted with one part of the hydroxy polymer.

Preferably the polyfunctional polyisocyanate comprises a tri-functional aliphatic polymer and the hydroxy functional polymer is selected from the group of hydroxylated styrene, acrylic co-polymers, hydroxylated polyesters, hydroxlated acrylics, styrenated allyl alcohols, epoxies, polylactones or polydimethylsiloxane.

The catalysts used with the above reactants are preferably Zinc Octoate or dibutyltin dilaurate.

The coating produced on the carrier particles is preferably an aliphatic-aeromatic cross-linked urethane coating; or the coating may be an aliphatically cross-linked or an aeromatically cross-linked urethane coating.

It has been found when using the coating according to the present invention that the particulate carrier material may vary in cross-sectional diameter from 30 to 450 microns and preferably with an outside surface area on said particles ranging from 160 to 320 square centimeters per gram of material.

The particulate carrier material is preferably a synthetic ferrite material but it is believed may also be from one of the other carrier material from the group of ferrite, steel shot glass beads or sand.

Most preferably according to the present invention the particulate carrier material is comprised of a ferromagnetic material which is a synthetic ferrite material. The synthetic material is comprised of one or more of the oxides of iron, zinc, copper and nickel. The most preferred ranges of composition are nickel oxide from 10.5 to 13% by weight, copper oxide from 2% to 3% by weight, zinc oxide from 20.3% to 27.7% by weight and the balance ferrous oxide. The preferable max cross-sectional diameters for the synthetic ferrites range from 30 to 150 microns.

BRIEF DESCRIPTION OF THE DRAWINGS

FIG. 7 is a schematic diagram of the fluidized bed process used with the present invention.

DETAILED DESCRIPTION OF THE DRAWINGS

The coating solution according to the present invention is prepared by blending a polyfunctional polyisocyanate with hydroxy containing a polymer in the presence of a catalyst to produce an aliphatic aeromatic cross-linkable urethane coating solution. The primary reaction can be represented as follows:

$$R_1—PH \neq OCN\text{-}R_2—R_1OCONH—R_2$$

where the $R_1$ represents an epoxie or polyester molecule and $R_2$ represents the polymeric part of the isocyanate molecule.

The primary reaction is between the (OH) group and the isocyanate to form the urethane linkage (OCONH). This reaction produces an aliphatic aeromatic cross-linked urethane which coats the substrate carrier material.

The cross linking possibilities are shown herein to be an epoxie to epoxie urethane cross-linked coating as presented by FIGS. 1–4 of the drawings.

Figure 1:
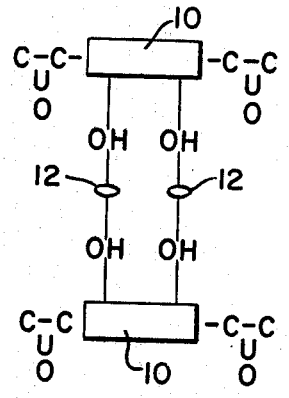
FIG. 1 is a representation of an epoxy cross-linked coating according to the present invention.

What is shown in FIG. 1 is a representation of an epoxie 10 to epoxie 10 cross-linked coating solution. Cross-linking is achieved by the urethane member 12 which attaches itself to the hydroxy members of the aeromatic component epoxie 10 represented in FIG. 1.

Figure 2:
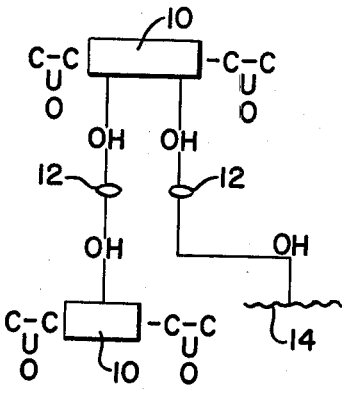
FIG. 2 is a representation of an epoxy to epoxy and epoxy to polyester cross-linked coating according to the present invention.

Shown in FIG. 2 is an epoxie 10 cross-linked with another epoxie 10 to a urethane 12 with the epoxie 10 forming the aeromatic component. An aliphatic component polyester 14 is also cross-linked by a urethane 12 with a hydroxy group from the epoxie 10. FIG. 2 represents an aeromatic aliphatic cross-linked component described in examplified in the examples that are to follow.

Figure 3:
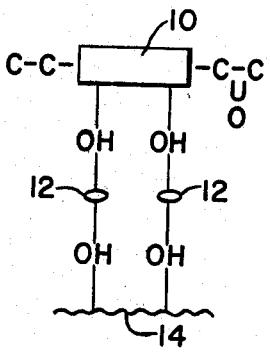
FIG. 3 is a representation of an epoxy to polyester coating according to the present invention.

Shown in FIG. 3 is an epoxie 10 aeromatic component cross-linked to a polyester aliphatic component 14 through the urethane components 12. The urethane 12 again attaches to the hydroxy components of the aeromatic and aliphatic components.

Figure 4:
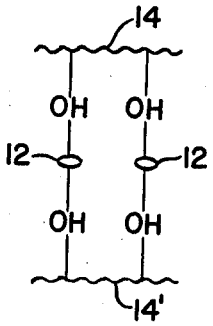
FIG. 4 is a representation of a polyester to polyester cross-linked coating according to the present invention.

FIG. 4 serves as a final representation of the cross-linking that can occur between an aliphatic polyester 14 and another aliphatic polyester 14' connected by the urethane number 12.

The coating solution consists of a total of four components in addition to a solvent. The formulation for the coating solution is 68.3% of ARALDITE 6084 dissolved in methyl ethyl ketone in about 35% solids. ARALDITE 6084 is an epoxie with an equivalent weight of 294 (gm/eq) based upon 100% solids.

The second component used is DESMOPHEN 650A-65 which is a hydroxylated polyester added to the existing solution in an amount of about 4.5% by weight on an as is basis. The DESMOPHEN is supplied from the manufactures at 65% solids in solution with an equivalent weight of 330 gm/eq.

The polyisocyanate, DESMODUR N-75, is added at about 27.2% by weight on an as is basis. DESMODUR is supplied at 75% solids and has an equivalent weight of 255 g/eq. These components are well blended prior to the addition of the catalyst. The catalyst, zinc octoate, is added at between 0.05 and 0.16% based upon the total weight of the coating solution and preferably between 0.10 to 0.13%.

Any suitable electroscopic toner material may be used with the carrier of this invention. Typical toner materials include: epoxy resins, polystyrene resins, vinyl toluene resins, polyester resins, methacrylic resins, styrene acrylic copolymer resins, acrylic copolymer resins and mixtures thereof. Typical pigmenting agents include carbon blacks and dyes.

Figure 5:
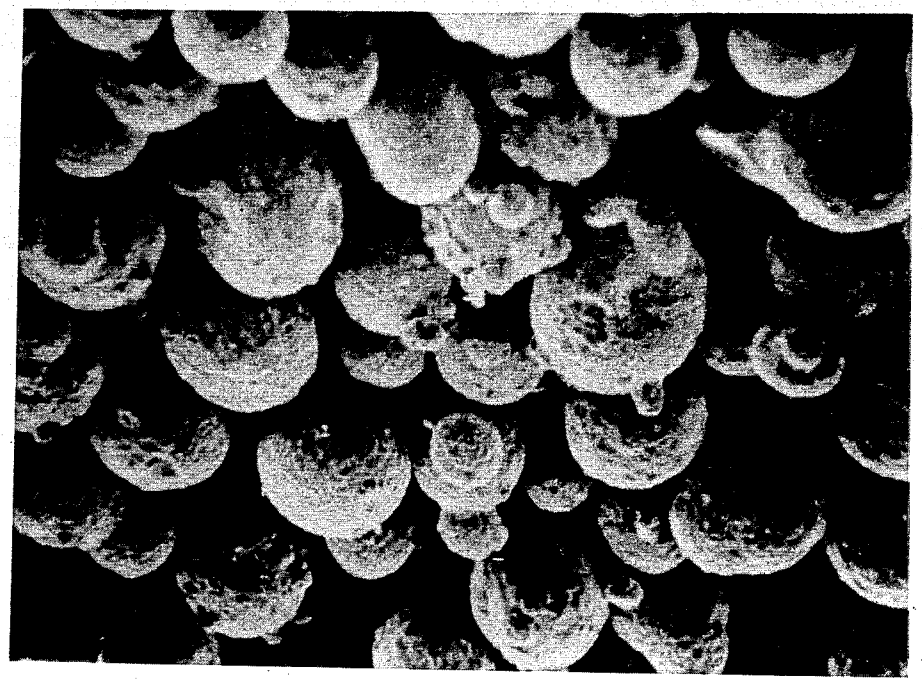
FIG. 5 is a view of a substrate material used with the present invention.

The following examples specifically described embodiments of this invention. The precentages are by weight unless otherwise indicated. Synthetic ferrite beads were used and were obtained from D. M. Stevens Co. and are designated as Raw CB-100. A photograph of 200X is shown in FIG. 5 of the Drawings.

In the following examples the triboelectric values are determined as follows: The relative triboelectric values generated by contact of carrier beads with toner particles are measured by means of a Faraday cage. The device comprises a brass cylinder having a diameter of 1 11/12 inch and a length of 1¾ inch. A 400 mesh screen is positioned at each end of the cylinder. The cylinder is weighed, charged with 5 grams of a mixture of carrier and toner particles and connected to go through a capacitor and an electrometer connected in parallel. Dry compressed air at 60 psi is then blown through the brass cylinder for 30 seconds. The charge on the capacitor is then read on the electrometer. Next, the chamber is reweighed to determine the weight loss. The resulting data is used to calculate the toner concentration and the charge in micro-coulombs per gram of toner. Since triboelectric measurements are relative, the measurements should for comparative purposes be conducted under substantially identical conditions. Thus, a toner comprising a styrene-n-butyl methacrylate copolymer and carbon black is used as a contact triboelectrification standard and as toner in all of the samples. Obviously, other suitable toners such as those listed above may be substituted for the toner used in the examples.

EXAMPLE I

A carrier coating solution is prepared by blending together 27.2% Desmodur N-75, 68.1% Araldite 6084 which is at 24.5% in MEK, 4.7% Desmophen 650-65 and 0.16% Zinc octoate. The solution had a solid concentration of 40%.

A synthetic ferrite having a nominal particle size of 90 micron and a surface area of 341 $cm^2/gm$ is preheated to a temperature of 195° F. and is coated with 2.27 kg of the solution using the WURSTER fluidized bed process. The solution was applied over a duration of twenty minutes and the coated carrier was fluidized for an additional ten minutes to insure complete evaporation of the solvent. The coated carrier was removed from the bed and was free flowing.

A developer mixture was prepared screening the carrier material −100≠270 mesh and mixing 0.7 parts styrene copolymer toner with about 100 parts screened carrier material. The relative triboelectric value of the carrier measured by means of a Faraday cage is about 12.8 microcoulombs per gram of toner.

EXAMPLE II

The experiment of Example I was repeated except that the amount of zinc octoate was reduced to 0.14%. The relative triboelectric value is about 12.5 microcoulombs per gram of toner.

EXAMPLE III

The experiment of Example I was repeated except that the amount of zinc octoate was reduced to 0.13%.

The relative triboelectric value is about 12.4 microcoulombs per gram of toner. The developer mix is machine tested in a Xerox 9400 duplicator and produces 150,000 copies before developing background and light image density.

EXAMPLE IV

The carrier materials described in Examples I, II and III are blended together and baked in an oven at 300° F. for 30 minutes to complete cross-linking.

The surface area of the cured carrier material was measured and determined to be 285 $cm^2/g$.

A developer mixture is prepared by mixing 0.7 parts styrene copolymer toner with about 100 parts cured carrier material. The relative triboelectric value of the carrier is about 15 microcoulombs per gram of toner. The developer mix is machine tested in a Xerox 9400 duplicator and produces 250,000 copies. Throughout the test, high image contrast and low background levels were maintained.

EXAMPLE V

Carrier material was prepared as in Example I except that the coating solution consists of a polymethyl methacrylate resin at 10% solids in 1,1,1-trichlorethane.

The surface area of the carrier material was measured and found to be about 400 $cm^2/g$.

A developer mixture was prepared by mixing 0.7 parts styrene copolymer toner and about 100 parts carrier material. The relative triboelectric value of the carrier is about 16 micro coulombs per gram of toner. The developer mix is machine tested in a Xerox 9400 duplicator and produces less than 100,000 copies before developing background and light image density.

Figure 6:
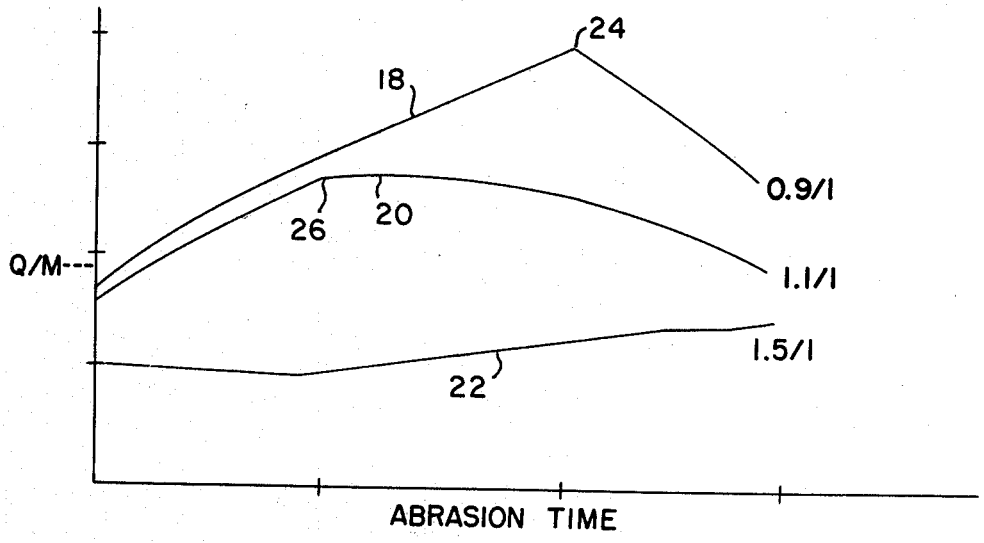
FIG. 6 is a graph exhibiting the improved results of the coated carrier according to the present invention.

What is shown in FIG. 6 is a graph of the charge/mass of the coated material verses the abrasion time. The charge/mass, of course, is the triboelectric charge mentioned earlier in the specification and it is desired that the charge/mass ratio remain as a constant or near constant as possible over the abrasive or life of the carrier particle. The change in the triboelectric value as has been mentioned before can seriously affect the quality of the copy coming out of the electrophotographic machine. Three lines on the graph, lines 18, 20 and 22 represent data from testing. In line 18 the method of preparing the coating solution comprised the steps of reacting the polyfunctional polyisocyanate in the range of 0.9 with one part of the hydroxy containing polymer. That can be seen by the formation of line 18 as abrasion time increased, the triboelectric charge also increased, until it peaked as at 24 of FIG. 6. As the abrasive time increased after it peaked at 24, the triboelectric value dropped off rather substantially.

With regard to line 20 it can be seen that the method used is to react a polyfunctional polyisocyanate in the range of 1.1 to one part of the hydroxy containing polymer. In doing so line 20 remained in a fairly more constant range over its abrasive life peaking at about at 26 and slowly dropping in triboelectric value or charge as abrasive time increased.

With regard to line 22 it can be seen that the most stable and therefore the most preferable triboelectric charge occurred when 1.5 parts of the polyfunctional polyisocyanate were reacted to one part of the hydroxy containing polymer. It can be seen even as the abrasion time has increased the most the triboelectric charges still only gradually increased in value and therefore it is seen that this would probably be the most preferable method of preparing coated components.

Abrasion testing was done by loading a predetermined quantity of the coated carrier material into a container and mounting the container on a paint shaker. The amount of time the container was mounted on the paint shaker represented "abrasive time."

Other modifications and ramifications of the present invention will occur to those skilled in the art upon a reading of the disclosure. These are intended to be included within the scope of this invention.

What is claimed is:

1. The method of coating a flowable carrier for use in electrophotographic recordings which comprise the steps of:

a. reacting from 1.4 to 1.55 parts of a polyfunctional polyisocyanate with one part of a hydroxy containing polymer in the presence of a catalyst to form a coating solution;

b. selecting the hydroxy containing polymer from the group of hydroxylated polyesters, hydroxylated acrylics, hydroxylated styrene acrylics, styrenated allyl alcohol, epoxie, polylacteons or polydimethylsilxane.

2. The method according to claim 1 which further comprises a. introducing the solution to the particulate substrate material by moving the particulates through a spray of the solution; and b. then moving the particulate material out of the spray and into a dry warm air region.

3. The method according to claim 2 which further comprises cycling the particulate material from the spray to the dry warm region until a predetermined coating thickness is built up on the outside of the particulate substrate material.

4. The method according to claim 3 which further comprises:

a. maintaining the temperature of the particulate substrate material at 190° F. to 210° F. while cycling the particulate material.

5. The method according to claim 4 in which the polyfunctional polyisocyanate comprises a tri-functional aliphatic polymeric isocyanate.

6. The method according to claim 4 in which the catalyst is selected from the group of Zinc octoate or dibutyltin dilaurate.

7. The method according to claim 1 which further comprises the steps of:

a. moving the particulate material out of the spray of coating solution into a dry warm air region b. and cycling the particulate substrate material from the spray of the coating solution to the warm air region and back to the spray of the coating solution until a desired coating thickness is built up on the outside of the particulate substrate material.

8. A flowable particulated carrier substrate material made in accordance with the method of claim 1.

9. A flowable particulated carrier substrate material coated in accordance with the method of claim 1.

10. A coated flowable carrier according to claim 8 which comprises a particulated substrate having an aliphatic and aeromatic cross-linked urethane coating over its outer surface.

11. A coated flowable carrier according to claim 10 for use in electrophotographic recordings which comprise a particulated substrate having an aeromatic cross-linked coating on its outer surface.

12. A coated flowable carrier according to claim 1 which comprises a particulated substrate having at least one of an aliphatic and aeromatic cross-linked urethane coating with outer surface wherein the coating is formulated by reacting from 1.4 to 1.55 parts of a polyfunctional polyisocynate with at least one part of hydroxy containing polymer wherein the hydroxy containing polymer is selected from the group of hydroxylated polyesters, hydroxylated acrylics, hydroxylated styrene acrylics, styrenated allyl alcohol, epoxie, polyactones and polydimethylsilxane.

13. A coated flowable according to claim 12 carrier for use in electrophotographic recordings which comprise a particulated substrate having an aliphatic cross-linked coating on its outer surface.

14. A coated carrier according to claim 12 in which said particulate substrate materials range in cross-sectional dimension from 30 to 450 microns.

15. A coated carrier according to claim 11 in which said particulate substrate material has an outside surface area that ranges from 160 to 350 square centimeters per gram of material.

16. A coated carrier according to claim 15 in which said substrate material is chosen from one of the group of steel shot, glass beads or sand.

17. A coated carrier according to claim 15 in which said particulate substrate material is comprised of a ferromagnetic material.

18. A coated carrier according to claim 17 is comprised of a synthetic ferrite material.

19. A coated carrier material according to claim 12 in which said particulate substrate material is comprised of a synthetic magnetic particle comprised of one or more of the oxides of iron, zinc, copper and nickel.

20. A coated carrier material according to claim 19 in which the cross-sectional dimension of the particles ranges from 30 to 150 microns.

21. A coated carrier according to claim 20 in which said particulate substrate material has substantially the following composition by weight:

| | |
|---|---|
| ferrous oxide | balance % |
| Zinc oxide | 20.3 to 27.7% |
| Copper oxide | 2 to 3% |
| Nickel oxide | 10.5–13% |

22. A developer material for an electrophotographic machine which comprises:

a. toner material b. carrier material c. said carrier material being coated with at least one of an aeromatic and alyphatic cross-linked urethane coating which is formulated by reacting from 1.4 to 1.55 parts of a polyfunctional polyisocyanate with one part of a hydroxy containing polymer wherein the hydroxy containing polymer is selected from the group of hydroxylated polyesters, hydroxylated acrylics, hydroxylated styrene acrylics, styrenated allyl alcohl, epoxie, polylactones or polydimethylsilxane.

* * * * *